US012507745B1

(12) United States Patent
Hartman

(10) Patent No.: US 12,507,745 B1
(45) Date of Patent: Dec. 30, 2025

(54) MULTI-POCKET TRAVEL COAT FOR PORTABLE STORAGE OF CLOTHING

(71) Applicant: Jason Hartman, Gulf Shores, AL (US)

(72) Inventor: Jason Hartman, Gulf Shores, AL (US)

( * ) Notice: Subject to any disclaimer, the term of this patent is extended or adjusted under 35 U.S.C. 154(b) by 0 days.

(21) Appl. No.: 19/002,690

(22) Filed: Dec. 27, 2024

(51) Int. Cl.
*A41D 3/04* (2006.01)
*A41D 27/20* (2006.01)
*A41D 31/10* (2019.01)

(52) U.S. Cl.
CPC ..... *A41D 3/04* (2013.01); *A41D 27/208* (2013.01); *A41D 31/10* (2019.02)

(58) Field of Classification Search
CPC ... A41D 3/02; A41D 3/04; A41D 3/00; A41D 13/0012; A41D 27/20; A41D 27/205
See application file for complete search history.

(56) References Cited

U.S. PATENT DOCUMENTS 208,151 A * 9/1878 Carter ..... A41D 3/02 2/85
1,724,343 A * 8/1929 Conover ..... A41D 13/0012 2/94
1,773,442 A * 8/1930 Speh ..... A41D 3/02 2/97
2,073,231 A * 3/1937 Siegel ..... A41D 3/02 2/97
2,368,654 A * 2/1945 Frank ..... A41D 3/00 2/84
2,865,025 A * 12/1958 Hennessey ..... A41D 13/0012 D2/839
3,077,605 A * 2/1963 Salvatore ..... A41D 3/02 2/97
4,475,251 A * 10/1984 Hopkins ..... A45C 9/00 2/85
4,876,724 A * 10/1989 Suzuki ..... H05K 11/00 381/301
D323,733 S * 2/1992 Shalom ..... D2/831
RE40,613 E * 1/2009 Jordan ..... A41D 27/205 2/94
8,756,716 B2 * 6/2014 Jordan ..... A41D 1/005 2/247
11,337,471 B2 * 5/2022 Schwirtz ..... A41D 15/04
(Continued)

*Primary Examiner* — Jillian K Pierorazio
(74) *Attorney, Agent, or Firm* — Sam Pierce

(57) ABSTRACT

The present invention relates to a multifunctional travel coat designed to serve as outerwear and as a portable storage solution for clothing. The travel coat features a durable and lightweight construction with integrated storage compartments, including four internal breast pockets disposed in an inner lining and five external back pockets, each equipped with zipper closures for secure item retention. The internal pockets are ergonomically positioned for ease of access to smaller items of clothing, while the external back pockets provide additional capacity for larger items. The garment is designed with reinforced seams, durable materials, and ergonomic features to distribute weight evenly, ensuring wearer comfort and mobility during travel. Optional features include adjustable straps for fit customization, a ventilation system for enhanced breathability, and locking zippers for added security. This innovative travel coat eliminates the need for separate luggage, providing travelers with a practical, stylish, and functional solution for carrying essentials.

11 Claims, 6 Drawing Sheets

(56) References Cited

U.S. PATENT DOCUMENTS

| | | | | |
|---|---|---|---|---|
| 2002/0059674 | A1* | 5/2002 | Blauer | A41D 3/04 2/87 |
| 2008/0060112 | A1* | 3/2008 | Driehorst | A41D 13/015 2/85 |
| 2016/0120244 | A1* | 5/2016 | Maier | A41D 1/04 2/96 |
| 2016/0270460 | A1* | 9/2016 | Rabinowitz | A41D 15/04 |
| 2016/0331052 | A1* | 11/2016 | West | A41D 27/02 |
| 2017/0082403 | A1* | 3/2017 | Aquino | F41H 1/02 |
| 2017/0156414 | A1* | 6/2017 | Shadid | A01K 27/003 |
| 2018/0206566 | A1* | 7/2018 | Ramirez | A41D 31/12 |
| 2019/0000157 | A1* | 1/2019 | Bhaskaran | A41D 27/20 |
| 2019/0098948 | A1* | 4/2019 | Studinger | A41D 1/02 |
| 2019/0380403 | A1* | 12/2019 | Schwirtz | A41D 1/06 |
| 2020/0337393 | A1* | 10/2020 | Shadid | A41D 27/201 |

* cited by examiner

MULTI-POCKET TRAVEL COAT FOR PORTABLE STORAGE OF CLOTHING

BACKGROUND OF THE INVENTION

Field of Invention

The present invention pertains to the field of wearable garments and travel accessories, with a specific focus on multifunctional outerwear. More particularly, the invention relates to a travel coat designed to combine the functionalities of a traditional overcoat with integrated storage capabilities, featuring a plurality of strategically placed, secure pockets with closures, including internal breast pockets.

Prior art coats with integrated storage have largely focused on electronics which are small and portable but heavy. For example, U.S. Pat. No. 8,756,716 discloses an improved garment pocket system which securely holds personal items with easy access to a touch screen feature of an electronic device. A garment includes a pocket system accessible from one or more garment surfaces allowing a user to store an external electronic device therein having a touch control surface. The pocket system includes an access panel which is an optically transmissive and control transmissive panel and a guiding system for receiving and positioning the touch control surface proximate the access panel for a user-access exterior to the pocket system. The improved garment pocket system may be retained proximate the garment surface or may externally descend from the garment surface for greater user control.

The present invention on the other hand is designed to accommodate clothing, and other soft items, thereby minimizing the need for separate luggage and enhancing convenience for travelers and fulfilling a long-felt need in the art.

BRIEF SUMMARY OF THE INVENTION

The present invention provides a novel travel coat that serves as a wearable storage solution, addressing the need for convenient and secure transportation of clothing during travel. The coat is innovatively constructed to integrate multiple storage compartments, each equipped with a closure mechanism such as a zipper, to ensure the safe retention of items while maintaining the aesthetic and functional integrity of the garment. The design incorporates ergonomic placement of pockets to optimize accessibility and weight distribution, enhancing wearer comfort and mobility. This invention eliminates the reliance on auxiliary luggage for carrying essential items, offering a seamless combination of utility and fashion for travelers.

DETAILED DESCRIPTION

Figure 1B:
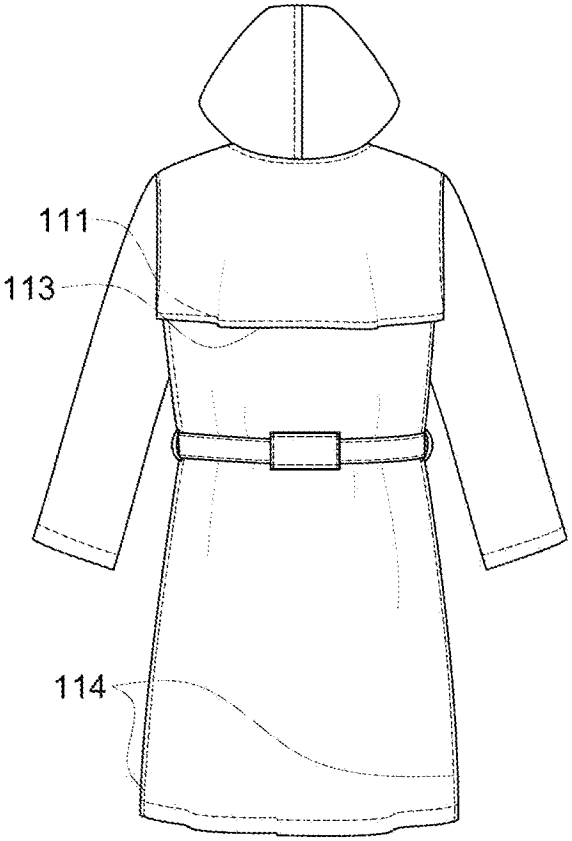
FIG. 1: A full view of the travel coat showcasing the front and back design, illustrating key construction details, including hems, seam types, and stitching configurations.

The present invention is directed to a multifunctional travel coat specifically designed to provide a comprehensive solution for clothing in a secure and convenient manner, while preserving the wearer's mobility and comfort. The travel coat, herein referred to as the "garment," is structured to function both as a traditional outerwear item and a portable storage system, enabling the wearer to forgo separate luggage for a variety of essential items.

The garment is constructed from durable and lightweight materials selected to support the added weight of stored items without compromising wearer comfort. These materials may include, but are not limited to, reinforced fabrics such as ripstop nylon, polyester blends, or other resilient textiles capable of withstanding stress and wear during prolonged use. The garment is further treated with water-resistant or water-repellent coatings to safeguard stored items from environmental exposure.

The garment features a plurality of integrated storage compartments strategically positioned for accessibility, security, and weight distribution. These compartments include four internal breast pockets located on the inner lining of the garment, symmetrically distributed to maintain balance. Each internal pocket is dimensioned to accommodate clothing, and is equipped with a zipper closure to ensure item retention. The internal pockets are discreetly integrated into the design, providing an inconspicuous appearance while maintaining a high level of security for valuable items.

In addition to the internal breast pockets, the garment incorporates five external pockets situated on the back panel. These back pockets vary in size to accommodate a range of clothing. The positioning of the back pockets is optimized to distribute weight evenly across the wearer's back, reducing strain and enhancing ergonomic comfort. Each of the back pockets is also fitted with a zipper closure, ensuring the secure containment of items during use.

The garment further includes structural reinforcements, such as double-stitched seams and reinforced pocket linings, to support the weight of stored items. The zippers are selected for their durability and smooth operation, with options for locking mechanisms to provide additional security if required. The coat's overall design incorporates aesthetic considerations, ensuring a modern and professional appearance suitable for diverse environments, including casual and business travel.

The embodiment described herein is optimized for ergonomic weight distribution for storing articles of clothing on one's person, and criticality exists for the particular arrangement of compartments in the preferred embodiment depicted in the accompanying drawings.

Additional features may include adjustable straps or fasteners to customize the fit of the garment, ensuring optimal comfort for a range of body types. The garment may also be equipped with an optional ventilation system, such as mesh-lined openings, to enhance breathability during extended wear.

In operation, the wearer can load the garment with clothing needed for a trip, thereby eliminating the need for separate bags or carry-ons. The ergonomic placement of pockets ensures ease of access to frequently used items while maintaining an even weight distribution to prevent discomfort or imbalance. The garment thus serves as a versatile, all-in-one solution for travelers seeking to streamline their carry-on needs without sacrificing functionality or style.

The present invention provides an innovative travel coat with integrated storage features that combine utility, comfort, and security, making it an indispensable accessory for modern travelers. The inventive design not only addresses the practical challenges of carrying clothing on one's person but also enhances the overall travel experience by offering a stylish and functional alternative to traditional luggage solutions.

DETAILED DESCRIPTION OF FIGURES

Figure 1A:
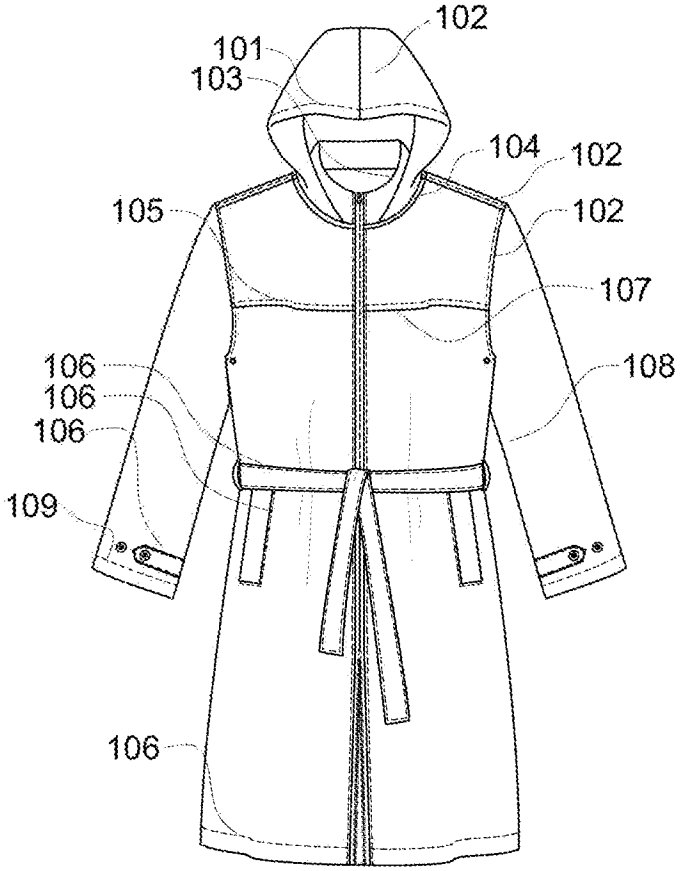

FIG. 1 illustrates a full view of the travel coat, depicting both the front and back designs with detailed construction elements. The front features a 1-inch clean finish hem (101) at the base for a polished appearance. The seams are reinforced with a 4-thread join using a 0.25-inch safety narrow twin stitch. (SNTS) (102), providing durability. The edges are neatly folded (103) and finished with a 0.25-inch SNTS (104) for structural stability. The hem is further reinforced with a 0.375-inch clean finish (105), while an edge stitching (106) ensures seam integrity. An open section (107) facilitates easy wear, and a second 4-thread join (108) adds additional strength. The front also includes dual 1.25-inch clean finish hems (109 and 110) at the lower edges for aesthetic appeal. On the back, the design incorporates a 0.375-inch clean finish hem (111) and open sections (113) for ergonomic functionality. The back seams are reinforced with a 4-thread join and a 0.25-inch SNTS (114) for enhanced structural stability and durability.

Figure 2B:
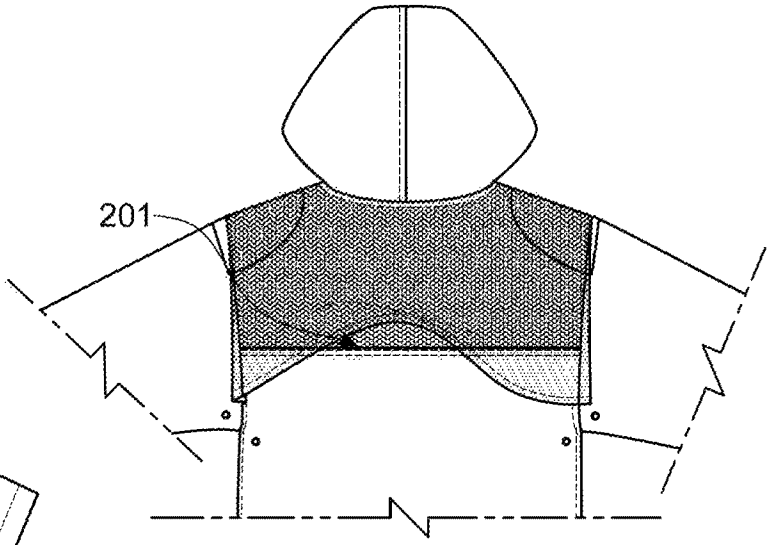
FIG. 2: A transparent view of the top half of the travel coat, displaying the inner structure and construction elements of both the front and back panels.
Figure 2A:
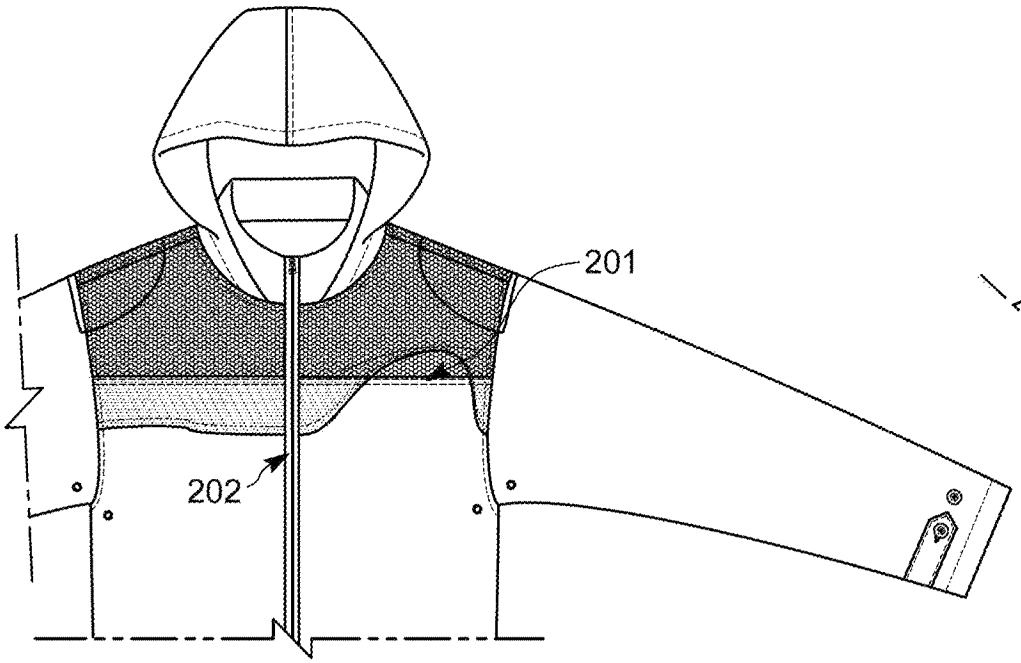

FIG. 2: provides a transparent view of the top half of the travel coat, highlighting the internal construction of both the front and back panels. The back and front incorporate a felled seam (202), designed to provide a smooth and secure finish while enhancing the garment's durability and comfort. The front includes a two-way open-ended zipper (201), sewn with the teeth facing inward to ensure a sleek appearance and smooth operation. This transparent overlay emphasizes the functional integration of structural elements into the garment design. The zippers can be metal or plastic, for example.

Figure 3:
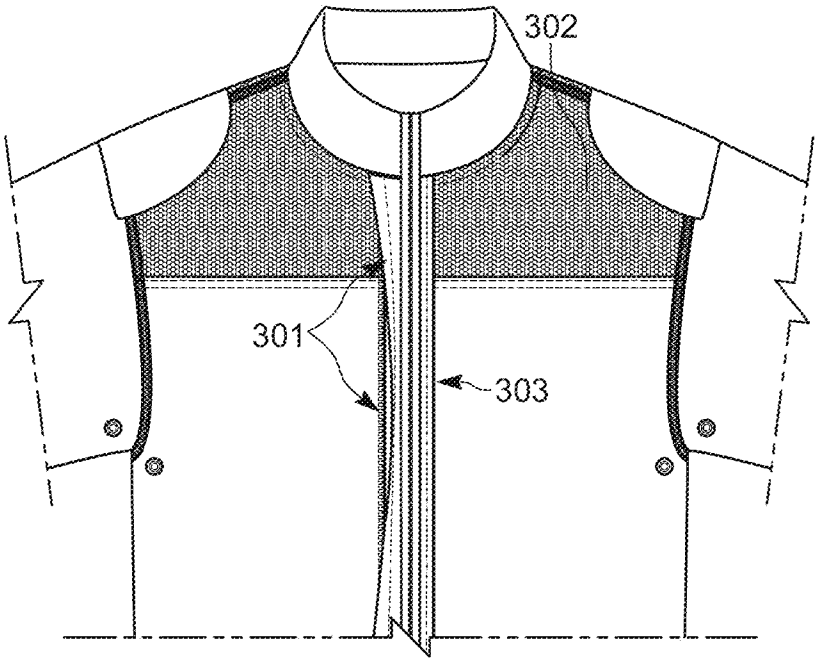
FIG. 3: A detailed view of the external breast pockets on both sides of the travel coat, illustrating the open zippers and the configuration of the five individual pockets.

FIG. 3: focuses on the external breast pockets, showcasing the configuration of pockets on both sides of the travel coat. The open zippers reveal five individual pockets designed for secure and accessible storage. The detachable lining is equipped with a zipper (301), allowing for easy removal or replacement. The side with mesh pocketing (302) is oriented outward, providing breathability and lightweight functionality. The opposing side (303) features zipper openings facing inward to securely clothing. This figure highlights the ergonomic and practical design of the external storage elements.

Figure 4:
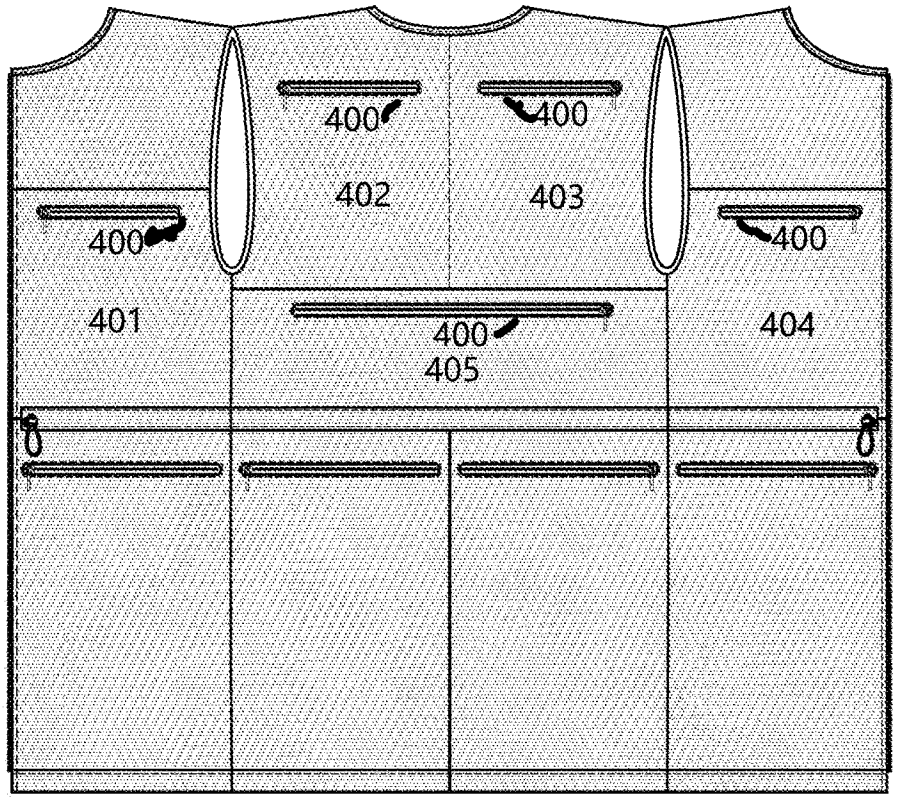
FIG. 4: An interior view of the travel coat, revealing the placement and arrangement of all nine internal and external pockets.

FIG. 4: presents an internal view of the travel coat, detailing the arrangement of all nine integrated pockets. The four internal breast pockets are symmetrically positioned on either side of the coat's interior, providing accessible and secure storage for clothing as the pockets are concealed from third-party view. The five external back pockets are visible from the inside, arranged to optimize storage capacity while maintaining balance and wearer comfort. This detailed view underscores the comprehensive storage solution provided by the travel coat's design.

Figure 5:
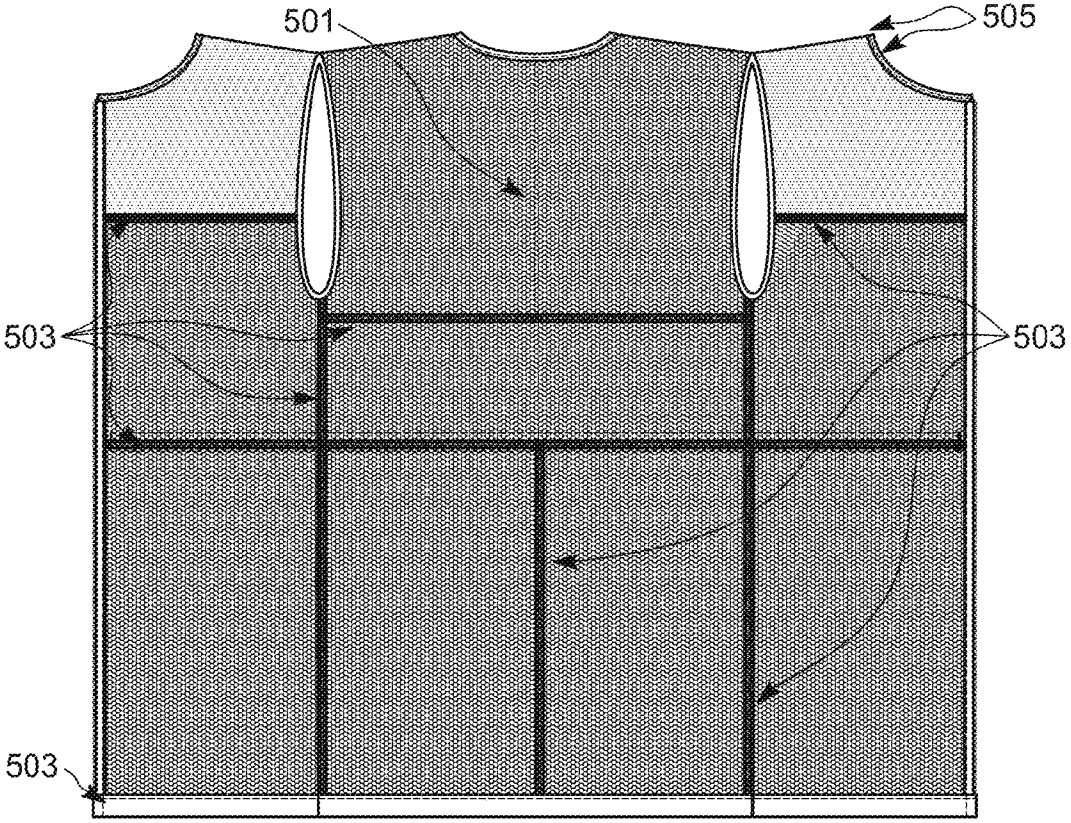
FIG. 5: A close-up view of the coat lining, showing its structural construction, seam details, and finishing techniques as it faces outward toward the shell.
Figure 6A:
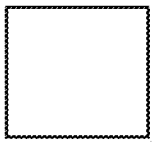
FIG. 6: A fabric map detailing the material distribution across various sections of the travel coat, highlighting areas of reinforcement and functional zones.
Figure 6B:
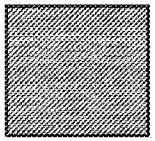
Figure 6C:
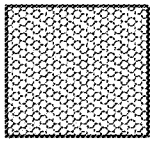
Figure 6D:
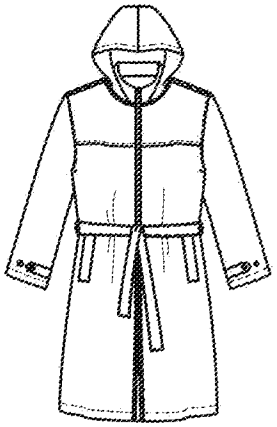
Figure 6F:
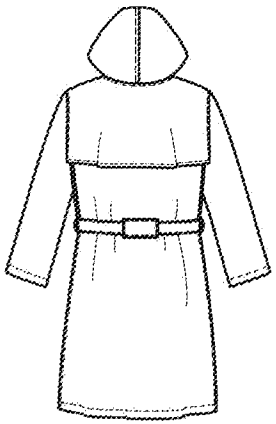
Figure 6E:
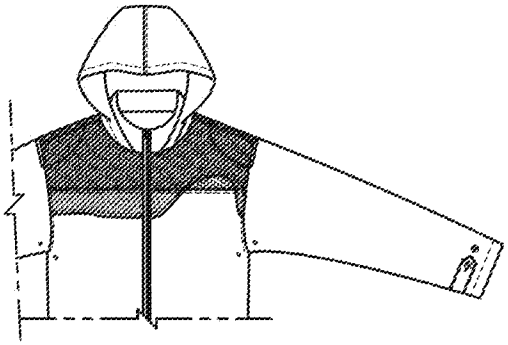
Figure 6G:
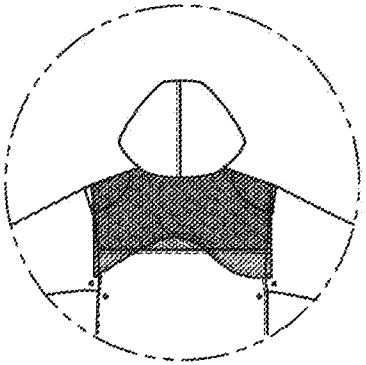
Figure 6H:
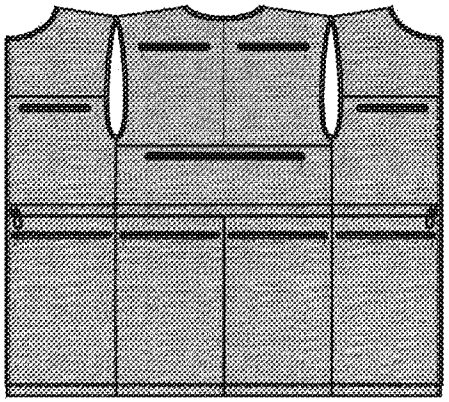
Figure 6I:
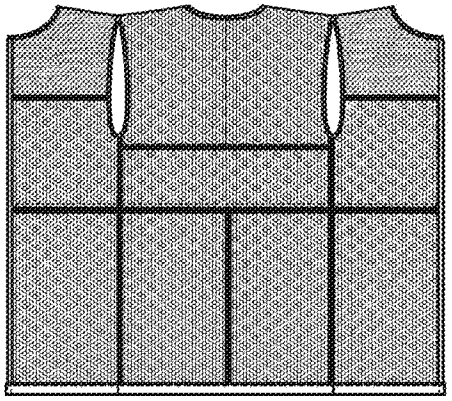

FIG. 5: focuses on the coat's lining as it faces outward toward the shell, illustrating the structural details of its construction. The lining incorporates SNTS stitching (501) through both layers, ensuring strength and durability. A 4-thread join (503) reinforces the seams, enhancing the garment's resilience under stress. The hem is finished with a 1.25-inch clean fold (504), providing a neat and robust edge. A 0.375-inch binding (505), made from the same material as the lining, reinforces critical areas while contributing to the overall aesthetic of the garment. This figure emphasizes the attention to detail in the coat's lining construction.

FIG. 6: depicts a fabric map, detailing the distribution of materials across the travel coat. This map highlights specific zones of reinforcement, such as pocket areas and high-stress regions, where durable fabrics are utilized. Lightweight and breathable materials are allocated to non-load-bearing areas to enhance comfort and mobility. The fabric map ensures clarity on the selection and application of materials, aligning with the garment's functional and ergonomic requirements.

Having thus described a few particular embodiments of the invention, various alterations, modifications, and improvements will readily occur to those skilled in the art. Such alterations, modifications, and improvements are intended to be part of this description though not expressly stated herein, and are intended to be within the spirit and scope of the invention. Accordingly, the foregoing description is by way of example only of several of many potential embodiments, and not limiting. Other embodiments are adaptable to meet various regulatory standards and/or different market needs in different jurisdictions and with different customer segments, for example, size of the garment and the pockets therein, materials used, manufacturing techniques.

What is claimed is:

1. A travel coat comprising:

a. a garment body constructed from a durable, lightweight, and water-resistant material;

b. a plurality of internal pockets positioned within an inner lining of the travel coat, wherein:

i. at least four internal breast pockets are symmetrically disposed on opposing sides of the garment;

ii. each internal pocket is dimensioned to accommodate items of clothing; and iii. each internal pocket is equipped with a zipper closure to securely retain items;

c. a plurality of external pockets positioned on the back portion of the garment, wherein:

i. at least five external back pockets are disposed across the back panel of the garment;

ii. each external pocket has a different size to accommodate various clothing items; and iii. each external pocket is equipped with a zipper closure; and d. a plurality of reinforced seams and pocket linings designed to support the weight of items stored within the pockets.

2. The travel coat of claim 1, wherein the zippers for each pocket are configured with mechanisms to provide additional security for stored items.

3. The travel coat of claim 1, further comprising adjustable straps or fasteners integrated into the garment to allow customization of the fit for wearers of varying body types.

4. The travel coat of claim 1, further comprising a ventilation system, wherein mesh-lined openings are strategically positioned to enhance breathability and wearer comfort during extended use.

5. The travel coat of claim 1, wherein the material of the garment body is treated with a water-repellent coating to provide protection against environmental conditions, including rain and moisture.

6. The travel coat of claim 1, wherein the internal and external pockets are configured to distribute weight evenly across the garment to minimize physical strain on the wearer.

7. The travel coat of claim 1, wherein the garment includes aesthetic design features that render it suitable for casual, business, and formal travel settings.

8. The travel coat of claim 1, wherein at least one internal breast pocket includes a padded lining to provide additional protection for fragile clothing items.

9. The travel coat of claim 1, wherein the external back pockets are equipped with reinforced zippers capable of withstanding repeated use under stress conditions.

10. The travel coat of claim 1, further comprising concealed compartments integrated within the garment for storing valuables, such as wallets or passports, with enhanced security features.

11. The travel coat of claim 1, further comprising one or more ergonomic design features to distribute weight evenly across the wearer's body for enhanced comfort and mobility.

* * * * *